US009096978B2

(12) United States Patent
Carlson

(10) Patent No.: US 9,096,978 B2
(45) Date of Patent: Aug. 4, 2015

(54) EXPANDABLE ROADSIDE SAFETY APPARATUS

(71) Applicant: Patrick E. Carlson, Brunswick, OH (US)

(72) Inventor: Patrick E. Carlson, Brunswick, OH (US)

(73) Assignee: Black Bart, Inc., Brunswick, OH (US)

( * ) Notice: Subject to any disclaimer, the term of this patent is extended or adjusted under 35 U.S.C. 154(b) by 93 days.

(21) Appl. No.: 14/064,752

(22) Filed: Oct. 28, 2013

(65) Prior Publication Data

US 2015/0117948 A1 Apr. 30, 2015

(51) Int. Cl.
*E01F 13/04* (2006.01)
*E01F 13/02* (2006.01)

(52) U.S. Cl.
CPC ..... *E01F 13/02* (2013.01); *E01F 13/028* (2013.01); *E01F 13/044* (2013.01); *E01F 13/048* (2013.01)

(58) Field of Classification Search
CPC ..... E01F 13/06; E01F 13/00; E01F 13/048; E01F 13/022; E01F 13/02; E01F 13/028; E01F 13/04; E01F 13/044; E01F 15/00; E01F 15/02; E01F 15/04; E01F 15/043; E01F 15/025; E06B 9/262; E06B 9/327; E06B 9/32; E06B 9/0692; E04B 2/827
USPC ..... 404/6; 160/84.06; 52/64, 238.1, 243.1
See application file for complete search history.

(56) References Cited

U.S. PATENT DOCUMENTS

| | | | | | |
|---|---|---|---|---|---|
| 2,221,357 | A * | 11/1940 | Moore et al. | ..... | 160/135 |
| 5,272,848 | A * | 12/1993 | Maas | ..... | 52/238.1 |
| 5,365,991 | A * | 11/1994 | Wright et al. | ..... | 160/84.04 |
| 5,704,592 | A * | 1/1998 | White et al. | ..... | 256/25 |
| 6,550,491 | B1 * | 4/2003 | Bixler et al. | ..... | 135/145 |
| 7,174,617 | B2 * | 2/2007 | Wright | ..... | 29/428 |
| 7,213,632 | B1 * | 5/2007 | Goldstein et al. | ..... | 160/135 |
| 8,082,969 | B2 * | 12/2011 | Okachi | ..... | 160/84.06 |
| 8,365,798 | B2 * | 2/2013 | Feldpausch et al. | ..... | 160/84.06 |
| 8,857,496 | B2 * | 10/2014 | Raniere | ..... | 160/135 |
| 8,893,762 | B2 * | 11/2014 | Ryan et al. | ..... | 160/135 |
| 2003/0197165 | A1 * | 10/2003 | Perelli | ..... | 256/26 |
| 2006/0076544 | A1 * | 4/2006 | Kurple | ..... | 256/26 |

* cited by examiner

*Primary Examiner* — Abigail A Risic
(74) *Attorney, Agent, or Firm* — Tucker Ellis LLP

(57) ABSTRACT

An expandable roadside safety apparatus is disclosed herein. The apparatus may include a plurality of partition sections and a plurality of curtain sections. Each partition section comprises a base portion, at least one cable located laterally through the base portion, and a plurality of rollers. The partition sections are configured to be extended and retracted via the cable. Each curtain section comprises at least one foldable section, at least one mounting bar, and a plurality of strips. A plurality of hinges may be secured between the partition sections and curtain sections, wherein the partition sections are configured to be hingedly secured to each other and to the curtain sections. The partition sections and the curtain sections may be interspersed between one another, wherein the apparatus is configured to be extended and retracted along the at least one cable.

20 Claims, 5 Drawing Sheets

EXPANDABLE ROADSIDE SAFETY APPARATUS

FIELD OF INVENTION

The present invention generally relates to an expandable roadside safety apparatus and, more particularly, to a temporarily securable and portable expandable and retractable roadside safety barrier that may prevent rubbernecking and promote traffic flow and increased highway safety.

BACKGROUND

It is well known that safety officials and police officers are concerned with the safety of motor vehicle traffic and with maintaining the flow of motor vehicle traffic. It is also well known that traffic jams and secondary accidents may often be attributable to the slowdown and jamming of traffic at accident sites. Whenever an accident occurs, it not only slows traffic in the traffic lane where the accident occurs, but also results in the slowing of traffic in the opposite lane as a result of motorists slowing to look at the site of the accident.

Typically, freeway accidents in densely populated areas often cause traffic jams, partly as a result of curious drivers slowing down to see what event has caused the accident. Problems and difficulties have been encountered due to the slowdown of traffic which further induces traffic delays that greatly restrict current freeway systems' ability to handle higher traffic volume.

Accidents, stalled cars, and other roadway incidents often lead to traffic jams and additional accidents caused by curious drivers who slow down to look at the scene. Such traffic jams and accidents often continue to occur after emergency vehicles reach the scene, as the flashing lights and commotion associated with the clean-up and investigation distract other drivers.

The problems created by onlookers are not limited to just those vehicles in the lanes adjacent to the accident scene, but may also extend to vehicles in the lanes of traffic moving in the opposite direction, due to "rubbernecking" by passing motorists. Rubbernecking is the phenomena of motorists slowing down to observe an accident or anything unusual on the side of the road. The momentary slow down creates an imbalance in the space between cars. And, in a very short time drivers have concocted a traffic jam of their very own. That action shrinks the carrying capacity of the road, almost the same way a closed lane does. The effect bounces backward one car at a time, in a shock wave that lasts independently of the initial problem, so that there's often not even anything for the rubberneckers to see. Additionally, where the incident is near pedestrian traffic, curious passersby may stop to observe and unwittingly get in the way of the emergency crews and hinder the rescue and clean-up efforts.

Under present-day traffic conditions on express and highways, particularly in unfavorable weather, it is a common occurrence that a more or less serious accident becomes the cause of traffic jams and/or additional accidents due to the fact that other travellers slow down or even stop in the vicinity of the original accident scene in order to view the scene or, perhaps, in some cases to bring assistance to victims. It is well known that such behaviors frequently continue even after the arrival of emergency vehicles, such as police or patrol cars, towing cars, fire trucks, ambulances or the like, in spite of the fact that the rescue work would be greatly facilitated, if the road traffic proceeded as unhampered as possible.

Additional problems encountered with traffic jams and slowdowns reside in causing secondary accidents which may occur as the result of distracted drivers and emergency personnel at the scene are sometimes injured due to such distraction. An object of the present invention is to provide means, whereby a roadside accident scene may be rapidly and effectively shielded from view.

To address these issues traffic control devices have been implemented. There are numerous examples in the prior art of various devices to control or limit traffic access to restricted areas. Conventional temporary barriers in the form of marker cones may be used for temporary traffic control in accident or construction situations. The orange cones may sometimes not readily be seen outside of an immediate area where the cone is placed, particularly in poor weather conditions. The cones may also frequently be destroyed or badly damaged when inadvertently struck by a motor vehicle.

Flares are another conventional warning device for use with accidents or disabled motor vehicles. Flares have an advantage of being easily visible at night. However, a motorist who drives past one or more flares may be temporarily blinded by their brightness, thereby endangering the motorist and people in the vicinity of the motorist. The flare is particularly dangerous to use where an automobile collision causes a spillage of gasoline on a roadway. Flares may also release noxious fumes when they burn.

These conventional warning devices have several disadvantages. For example, some conventional warning devices are so small in size that the reflective surfaces bearing the warning signals on the conventional warning devices are barely noticeable so that drivers of incoming traffic may not notice the disabled vehicle.

Additional disadvantages may occur when weather conditions are poor. For example, since the size of the warning sign is usually small, when the weather condition is poor, drivers of the incoming traffic may not notice the sign. In addition, since the warning sign is separately erected at a distance from the disabled vehicle, it may easily be toppled when the warning sign is used in poor weather conditions.

Therefore, there is a need for an improved partition or screen that will separate and shield oncoming motorists' vision from a recently occurring accident, stalled cars, construction sites or other highway incidents, thereby maintaining the flow of traffic near the incident, so that passing motorists will be motivated to maintain speed and to leave the incident site as rapidly as possible. Such a screen or shield should be reusable, of a temporary nature and may be readily available for deployment at the incident site for temporarily obscuring oncoming motorist's view. When the incident is over, the shield may be returned to its stored condition for repeated use at other locations and times. Therefore, a need exists for a highly visible warning device that may be conveniently stored.

SUMMARY

An expandable roadside safety apparatus is disclosed herein. The apparatus may include a plurality of partition sections and a plurality of curtain sections. Each partition section comprises a base portion, at least one cable located laterally through the base portion, and a plurality of rollers. The partition sections are configured to be extended and retracted via the cable. Each curtain section comprises at least one foldable section, at least one mounting bar, and a plurality of strips. A plurality of hinges may be secured between the partition sections and curtain sections, wherein the partition sections are configured to be hingedly secured to each other and to the curtain sections. The partition sections and the curtain sections may be interspersed between one another, wherein the apparatus is configured to be extended and retracted along the at least one cable.

The apparatus is capable of being retracted into a storage position via the cable, whereby one end of the cable is configured to be secured to a winch. The curtain sections are configured to provide ingress and egress to either side of the apparatus. The base portion includes at least one stabilizing component that is configured to be secured to the ground. The apparatus may also include at least one lighting component secured to the partition sections and a GPS component secured to the partition sections. Each partition section includes a plurality of wind vents located laterally along the partition section. Each partition section may also include a plurality of reflective portions, whereby the reflective portions comprise a reflective tape or paint and the reflective portions 44 may be displayed in a specific pattern on the partitions.

BRIEF DESCRIPTION OF THE DRAWINGS

Objects and advantages together with the operation of the invention may be better understood by reference to the following detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention. Additionally, as used herein, the term "exemplary" is intended to mean serving as an illustration or example of something, and is not intended to indicate a preference.

Figure 3:
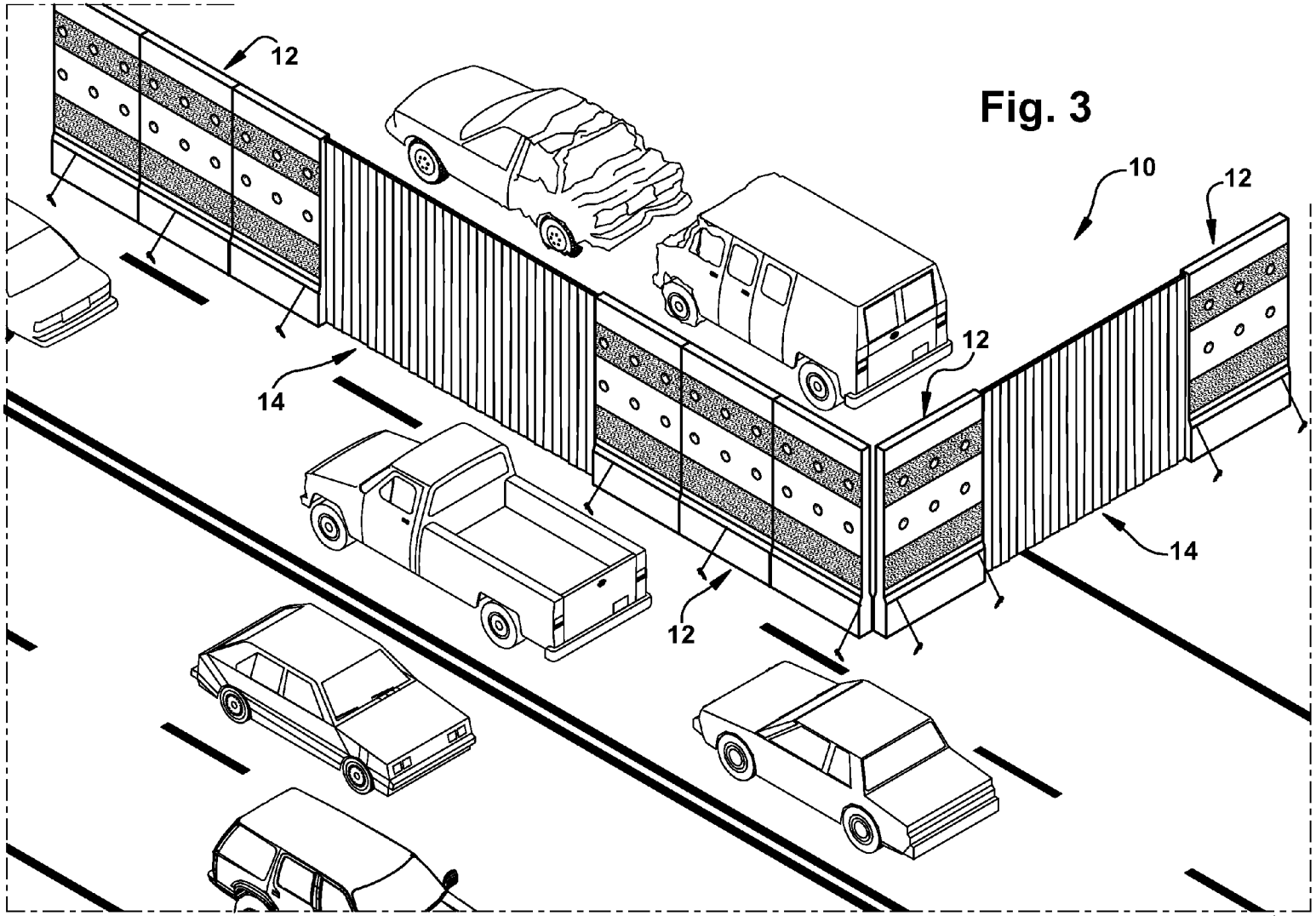
FIG. 3 illustrates an exemplary embodiment of a perspective view of the expandable roadside safety apparatus in use on the roadside with an accident.

An expandable roadside safety apparatus 10 (the "apparatus 10") is illustrated in FIGS. 1-9. The expandable roadside safety apparatus 10 may be a removable, securable and portable safety wall or barrier. The apparatus 10 may be used with and deployed from any appropriate type of vehicle, such as trucks, semi-trucks, etc. As shown in FIG. 3, the apparatus 10 may block passing motorists' and pedestrians' views of accidents, stalled cars, construction work and/or other roadway incidents.

The expandable roadside safety apparatus 10 may be utilized for any appropriate purpose. The apparatus 10 may help guide emergency personal to a disabled vehicle and/or guide passing motorists safely away from roadside accidents, construction or the like. The apparatus 10 may provide visibility at great distances from the accident or construction even on dark unlighted roads. The apparatus 10 may enhance road traffic safety by preventing accidents and other complications frequently caused by the curiosity of travelers on a roadway while passing the scene of a previous accident under clean-up and investigation by rescue and law enforcement personnel.

The apparatus 10 may prevent injury to those working at traffic accident areas, assist in traffic flow through an accident area, prevent more accidents from auto flow interruption, and prevent opposite direction traffic from viewing accidents and causing other accidents or impeding traffic flow to save safety forces from added area accidents.

The apparatus 10 may also benefit any area that is trying to protect workers, or prevent accidents from occurring, even help with the traffic flow pattern. The apparatus 10 may be used for any construction site on a roadway or off the roadway, such as utility company located close to the roadway projects. The apparatus 10 may be of use to help workers and keep the traffic flow around construction sites accident free, which may impede traffic. The apparatus 10 may act as a shield of safety that protects the safety of others on both sides of its walls.

The expandable roadside safety apparatus 10 may be of any appropriate shape, size, type or configuration. In an exemplary embodiment, the apparatus 10 may be of a generally rectangular shape and configuration, as best shown in FIGS. 1, 3-5 and 9. The expandable roadside safety apparatus 10 may be of varying length depending upon the situation it is to be utilized with. In addition, the apparatus 10 may be adjustable to varying lengths, as will be described below.

The expandable roadside safety apparatus 10 may be of any appropriate shape, size, or configuration, such as one that may be easily stored on a flat bed trailer or in a semi-trailer, such as a box trailer (not shown). The expandable roadside safety apparatus 10 may be fabricated from any appropriate material(s) and color(s). The expandable roadside safety apparatus 10 may include at least one partition section 12 and at least one curtain section 14. In an exemplary embodiment, the apparatus 10 may include a plurality of partition sections 12 and a plurality of curtain sections, whereby the partition sections 12 and curtain sections 14 may be interspersed amongst one another until the desired length and/or pattern of partition sections 12 and curtain sections 14 have been achieved, such as shown in FIGS. 1, 3, 4 and 9.

Each partition section 12 may be of any appropriate shape, size, type or configuration. Each partition section 12 may be fabricated out of any appropriate type of material(s), such as from metal(s), metal alloy(s), concrete, composite material(s), plastic material(s) or any combination of the same. In an exemplary embodiment, each partition may be of a generally rectangular shape and of a size approximately eight feet wide and approximately twelve feet tall.

As shown in FIGS. 1, 4-6 and 9, each partition section 12 may include a base portion 16. The base portion 16 may be of any appropriate shape, size or configuration. The base portion 16 may be integrally formed with the rest of the partition section 12 or it may be a separate component that may be secured to the rest of the partition section 12 via any appropriate means, such as fasteners, adhesives or the like. The partition sections 12 may include a first end 18 and a second end 20, as shown in FIGS. 1, 4-6 and 9. The base portion 16 may be located adjacent to the first end 18 of the partition section 12.

Figure 1:
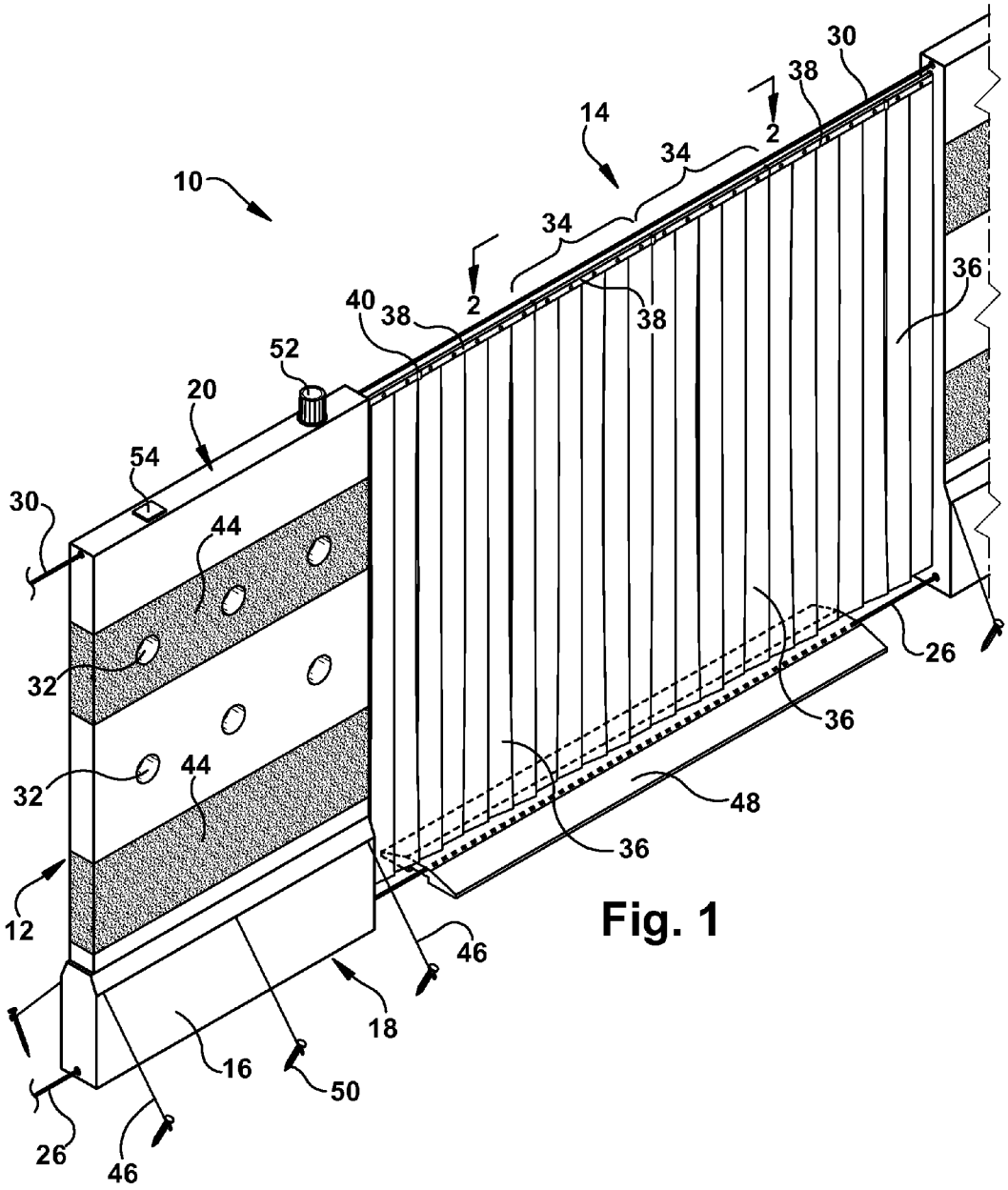
FIG. 1 illustrates an exemplary embodiment of a perspective view of an expandable roadside safety apparatus.
Figure 2:
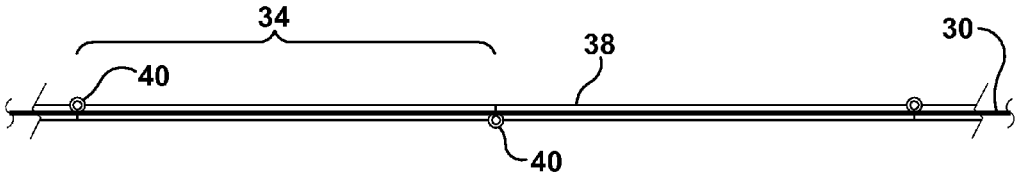
FIG. 2 illustrates a top sectional view of an embodiment of the expandable roadside safety apparatus of FIG. 1.
Figure 6:
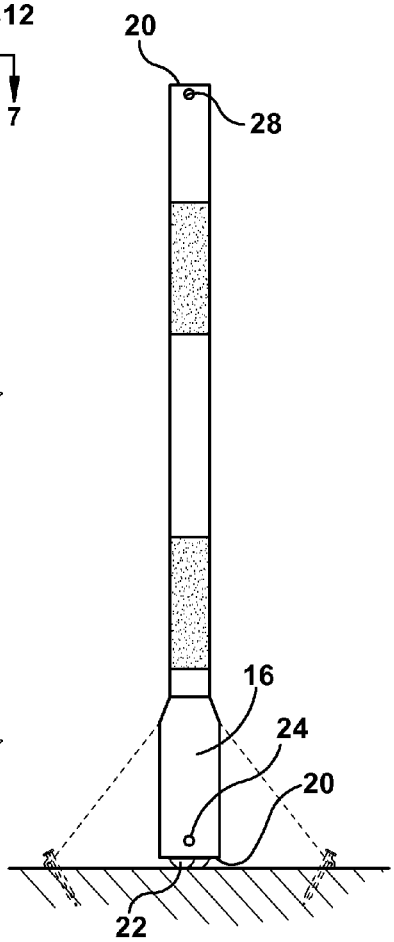
FIG. 6 illustrates a side view of the embodiment of the expandable roadside safety apparatus of FIG. 5.
Figure 7:
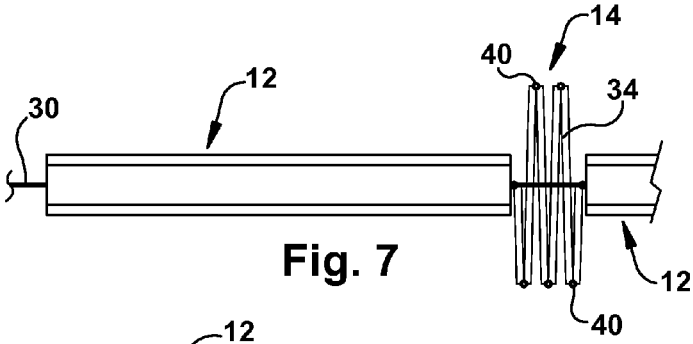
FIG. 7 illustrates a tops sectional view of the embodiment of the expandable roadside safety apparatus of FIG. 5.
Figure 9:
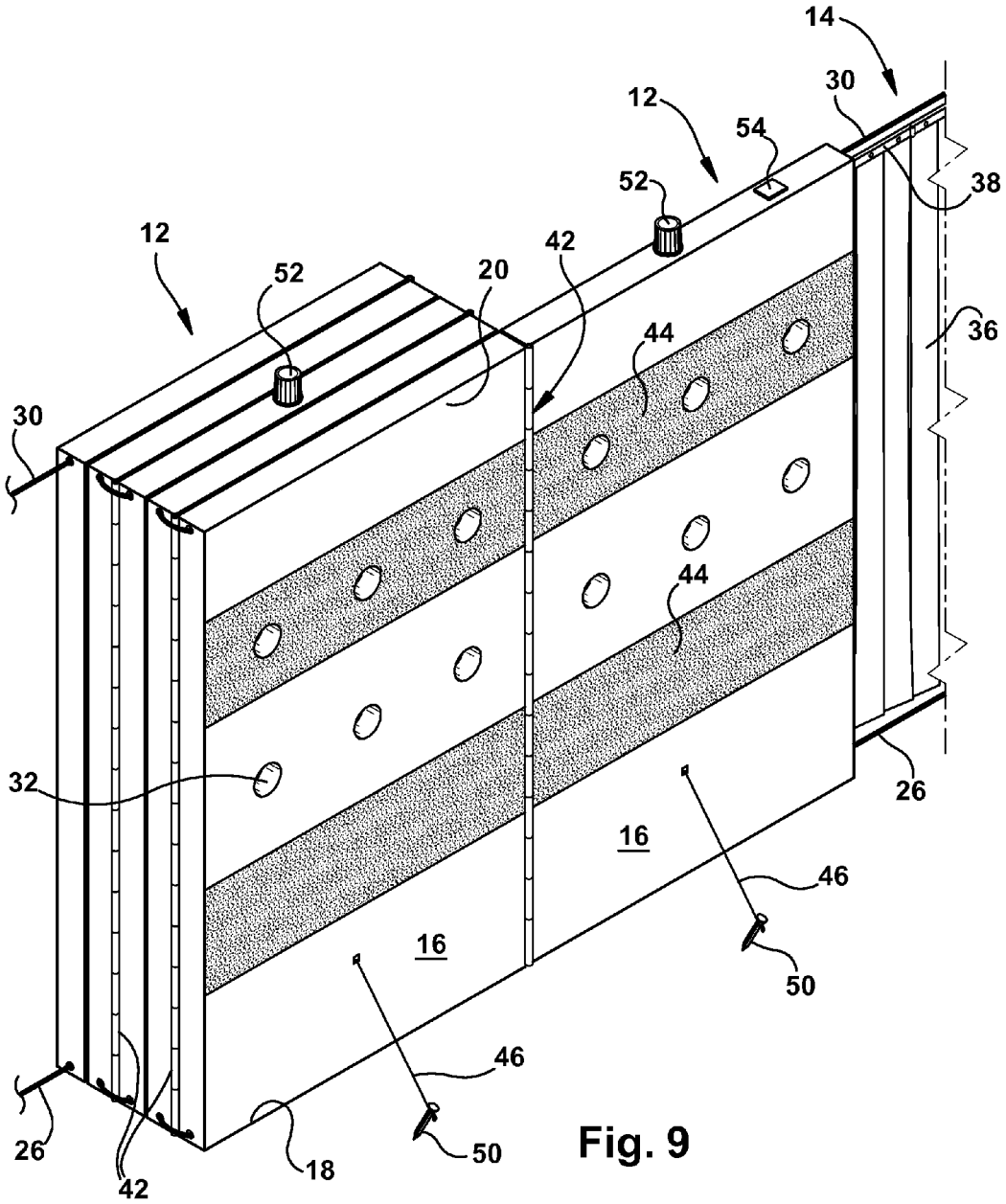
FIG. 9 illustrates a perspective view of an exemplary embodiment of the expandable roadside safety apparatus in a partially stored position.

The base portion 16 may be fabricated out of the same or of a different material than the rest of the partition section 12, whereby the base portion 16 may be of a heavy material and provide a sturdy base for the apparatus 10, and may be referred to as the weighted base portion 16. In an exemplary embodiment, the weighted base portion 16 may be wider on the bottom of the partition, whereby the weighted base portion 16 may have a larger footprint than the rest of the partition, as shown in FIGS. 1 and 6. Alternatively, the weighted base portion 16 may be of the same footprint as the rest of the partition, whereby it is not larger in size, as shown in FIG. 9.

The weighted base portion 16 may include a delivery system or delivery components, such as a manner to move the partitions easily along the ground, such as rollers 22 or wheels, as shown in FIGS. 4-6 and 8. The rollers 22 may be of any appropriate shape, size, type or configuration, such as of a generally spherical shape and of a size generally smaller than that of the footprint of the weighted base section, whereby the rollers 22 may be located beneath the weighted base section. The rollers 22 may be fabricated out of any appropriate type of material(s), such as a heavy duty metal or metal alloy material.

Figure 8:
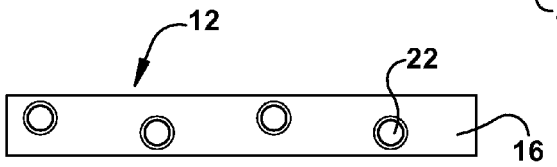
FIG. 8 illustrates a bottom sectional view of the embodiment of the expandable roadside safety apparatus of FIG. 5.

The weighted base portion 16 of the apparatus 10 may include any appropriate number of rollers, such as a plurality of rollers. In an exemplary embodiment, the weighted base portion 16 may include approximately four to six rollers. The rollers 22 may be located at any appropriate position on the weighted base portion, whereby the rollers 22 may be located at a spaced equidistant location apart from one another. In an exemplary embodiment, the rollers 22 may be positioned in a general zigzag pattern to provide greater stability to each partition section, as best shown in FIG. 8.

Figure 5:
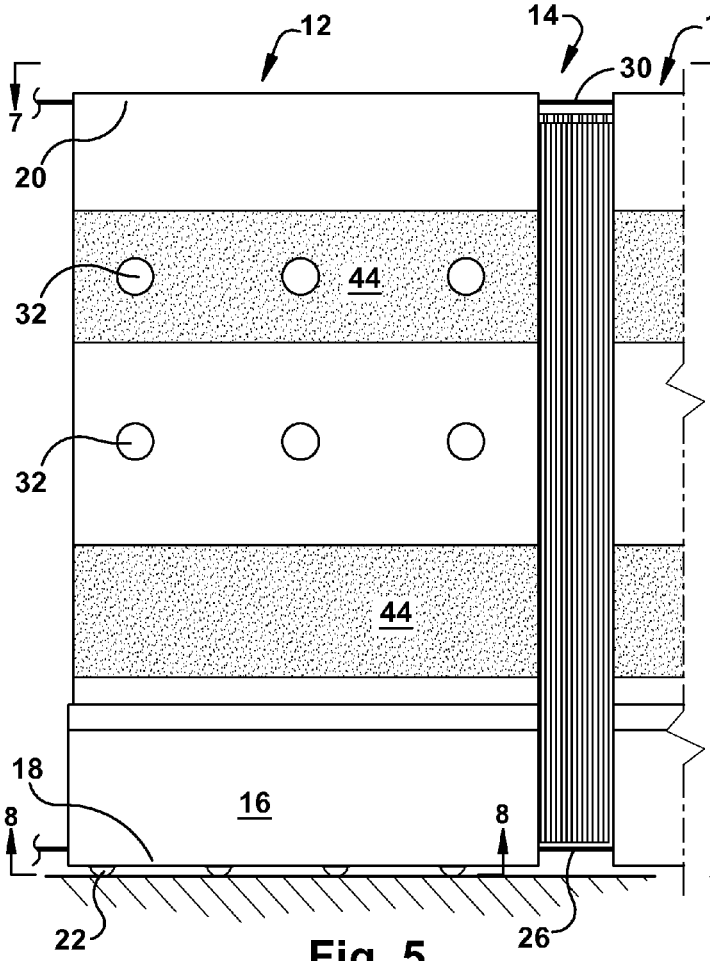
FIG. 5 illustrates a front view of an exemplary embodiment of the expandable roadside safety apparatus in a stored position.

The apparatus 10 may also include at least one aperture 24 and at least one cable 26. The aperture 24 may be of any appropriate shape, size, type or configuration. In an exemplary embodiment, each aperture 24 may be of an approximately circular shape. The aperture 24 may be located at any appropriate position on the partition section 12. In an exemplary embodiment, the aperture 24 may be located adjacent to the first end 18 of the partition section 12, whereby the aperture 24 may extend laterally along and through the weighted base portion 16 of each partition section 12, as shown in FIGS. 1, 5 and 6. For ease of reference, this aperture 24 may also be referred to as the first aperture 24.

Each cable may be of any appropriate shape, size, type or configuration. Each cable may be fabricated out of any appropriate type of material(s), such as an industrial strength metal or metal alloy cable. Additionally, each cable may include a hook or a loop (not shown) located at either end of the cable. The hook or loop may aid in extending and retracting the apparatus 10 during use. In one embodiment, the apparatus 10 may include a cable 26 located adjacent the first end 18 of the partition section, whereby the cable 26 may extend through the aperture 24 located in the weighted base section 16, as shown in FIGS. 1, 5 and 6. For ease of reference, this cable 26 may also be referred to as the first cable 26. The cable 26 may extend through the first aperture 24 to connect the partition sections 12. In this embodiment, the apparatus 10 may be retracted or reeled in by the first cable 26.

In another embodiment, the apparatus 10 may include an aperture 28 located adjacent to the second end 20 of the partition section 12, whereby the aperture 28 may extend laterally along and through the end opposite that of the weighted base portion 16 of each partition section 12. For ease of reference, this aperture 28 may also be referred to as the second aperture 28. The apparatus 10 may also include a cable 30 located adjacent the second end 20 of the partition section 12, whereby the cable 30 may extend through the aperture 28 located adjacent the second end 20 of the partition section 12, opposite that of the weighted base portion 16, as shown in FIGS. 1 and 4-6. For ease of reference, this cable 30 may also be referred to as the second cable 30. The cable 30 may extend through the second aperture 28 to connect the partition sections 12. In this embodiment, the apparatus 10 may be retracted or reeled in by the second cable 30.

In an alternative embodiment, the apparatus 10 may include a pair of cables 26, 30, whereby the first cable 26 may be located adjacent to the first end 18 of the partition section 12 and through the first aperture 24, whereas the second cable 30 may be located adjacent the second end 20 of the partition section 12 and through the second aperture 28, as shown in FIGS. 1 and 4-6. In this embodiment, the apparatus 10 may be retracted or reeled in by both the first cable 26 and the second cable 30.

Each partition of the expandable roadside safety apparatus 10 may include a plurality of wind vents 32, as shown in FIGS. 1, 3-5 and 9. Each partition may include any appropriate number of wind vents. In an exemplary embodiment, each partition may include six wind vents. The wind vents 32 may be of any appropriate shape, size or type. The number and size of the wind vents 32 may be dependent on the size of the particular apparatus 10 and how many partition sections 12 are utilized.

In an exemplary embodiment, the wind vents 32 may be of a generally circular shape. The wind vents 32 may be located at any appropriate position on the partition section, such as located transversely through one side of the partition to the other in a generally perpendicular direction to that of the cable apertures. In an exemplary embodiment, the wind vents 32 may be generally located at a spaced distance apart from one another along the generally central location of the partition, and may also be located between the generally central location of the partition and the second end 20 of the partition. The wind vents 32 may help prevent tip-overs as well as provide circulation on the opposite side.

Each curtain section 14 may be of any appropriate shape, size, type or configuration. Each curtain section 14 may be fabricated out of any appropriate type of material(s), such as from plastic material(s), fabric material(s) or any combination of the same. In an exemplary embodiment, each curtain section 14 may be of a generally square or rectangular shape and of a size approximately sixteen feet wide and approximately twelve feet tall.

As shown in FIGS. 1, 2, 4 and 7, each curtain section 14 may include a plurality of foldable sections 34. Each foldable section 34 may include a plurality of strips 36 and a mounting bar 38, as shown in FIGS. 1, 2, 4 and 7. The mounting bars 38 may be of any appropriate shape, size, type or configuration, such as of a generally rectangular shape. The strips 36 may be of any appropriate shape, size, type or configuration, such that the strips 36 may hang from the mounting bars 38 in a downward direction and provide separation between one side and the other of the apparatus 10. Each of the strips 36 may be of a generally similar size. A plurality of strips 36 may be secured together by the mounting bar 38 by any appropriate means, such as via fasteners, adhesive, or the like. In an exemplary embodiment, each mounting bar 38 may secure a certain number of strips, such as approximately five strips 36 for example.

The strips 36 of the curtain sections 14 may protect the generally "open" sections from excessive wind, dust, and debris, while maintaining the easy in and out of traffic, people and equipment. The strips 36 may be fabricated out of any appropriate type of material, such as of a generally heavy duty plastic material. The strips 36 may be fabricated from flexible anti-static vinyl (PVC) and static-safe polyurethane. Heavy-gauge materials may allow the strips 36 to hang straight, without the need for sewn hems or sash weights. The strips 36 may be fabricated of heavy-duty material ensuring tear resistance.

In an exemplary embodiment, the strips 36 may be frosted to provide for some cover between the two sides of the apparatus 10. Alternatively, the strips 36 may include reflective coating, tape and/or a pattern. One set may be for entry and the other may be for egress, whereby the entry section may include a certain pattern to indicate entry and the egress section may include a certain pattern to indicate egress.

The foldable sections 34 and mounting bars 38 may be foldably or hingedly secured to one another via fasteners, such as a hinge, which will be referred to as a curtain hinge 40. These curtain hinges 40 may be of any appropriate shape, size, type or configuration, whereby that the foldable sections, mounting bars, and thus the plastic strips 36 may fold back and forth onto each other during storage. Each curtain hinge 40 may be located between two foldable sections 34, as shown in FIGS. 1, 2, 4 and 7.

Each curtain section 14 may be of an appropriate size, whereby an emergency vehicle or construction vehicle may be able to drive through the curtain section 14 without hitting or touching the adjacent partition sections 12 or hitting or touching the mounting bars. Each foldable section 34, and thus each curtain section 14, may generally be located adjacent to and beneath the second cable 30 and second aperture 28 of the partition sections 12 of the apparatus 10.

There may be any appropriate number of foldable sections 34 located within each curtain section 14. In an exemplary embodiment, there may be approximately four to six foldable sections 34 located within each curtain section 14 of the apparatus 10. Connected to at least one partition section 12 may be at least one curtain section, whereby the plastic strips 36 may extend from approximately the same height as the second end 20 of the partition section 12 to near the ground level, such as above the first cable, for example. These curtain sections 14 may allow emergency vehicles and safety personnel in and out of the accident area at many access points for many vehicles at one time.

Connected to either side of the curtain section 14 may be another partition section 12 as described above. Alternatively, one or more curtain sections 14 may be attached to additional curtain sections 14 and/or one or more partition sections 12 may be attached to additional partition sections 12, whereby the curtain section 14 and partition sections 12 may be interspersed as desired. As shown in FIGS. 1, 3, 4 and 9, this pattern may be repeated until all sections have been extended, whereby the apparatus 10 has been extended to its desired length or distance to shield the roadside condition.

As illustrated in FIG. 9, in an alternate embodiment, when the partition sections 12 do not include a larger sized weighted base portion, each partition section 12 may be foldably or hingedly secured to one another, via fasteners, such as a hinge and a long pin, which will be referred to as a continuous hinge 42. These continuous hinges 42 may be of any appropriate shape, size, type or configuration, such that the continuous hinge 42 may run the length from the first end 18 to the second end 20 of the partition sections, whereby the partition sections 12, when located next to one another, may fold back and forth onto each other during storage.

The apparatus 10 may be rapidly and effectively delivered and placed into the desired position. The apparatus 10 may be mechanically or electronically extended for use and/or reeled in for storage. Depending upon which embodiment, as discussed above, is put into practice, one or more winches may be utilized to reel in the apparatus 10.

To deliver the apparatus 10, any appropriate type of vehicle or trailer may be utilized. For example, a semi-trailer, a custom flatbed truck trailer or any other appropriate type of trailer or transportation may be utilized. To deliver the apparatus 10 to the desired location, the apparatus 10 may be unloaded from the trailer or vehicle, put into the desired starting location, and then the vehicle may be driven away from the starting location, whereby the apparatus 10 may extend open and unfold from the storage position to the desired length to cover the accident site, construction site or the like. Once the apparatus 10 has been extended to the desired length, the vehicle may stop driving at the end location, whereby the apparatus 10 may be in position to shield the desired roadside situation.

To retrieve the apparatus 10 for storage, one or more winches may be utilized to reel the apparatus back into a storage position after use. In an exemplary embodiment, a high powered industrial retrieval winch may be utilized. Depending upon the embodiment, two winches may be utilized, whereby a first winch may reel in the first cable and a second winch may reel in the second cable in a simultaneous manner. The expandable roadside safety apparatus 10 may be collapsible or foldable whereby it may be conveniently stored and mounted on the storage trailer or vehicle.

The apparatus 10 may mark areas that need assistance related to emergency or non-emergency assistance or needs. The apparatus 10 may also satisfy distance and safety study results (i.e., such as size and candlelight power requirements among various types of reflective tape and material). In addition, the apparatus 10 may be U.S. Department of Transportation (DOT) compliant or similarly compliant with any necessary local, state and federal regulations. Additionally, the apparatus 10 may be compliant with any regulations relating to the American Disabilities Act (ADA).

In addition, the apparatus 10 may be brightly colored with a plurality of reflective portions 44, as shown in FIGS. 1, 3-6 and 9. For example, in an exemplary embodiment, each partition section 12 may include a plurality of reflective portions 44. Each reflective portion 44 may be of any appropriate shape or size. Each partition section 12 may be comprised of industrial strength reflective tape or paint. The reflective portions 44 of the partition sections 12 may be of any appropriate colors, such as orange, yellow, white, red and the like.

The reflective material may comprise a retrorefrlector material, such as reflective tape, for example. A retroreflector is a device or surface that reflects light back to its source with a minimum of scattering. Retroreflection is often used on road surfaces, road signs, vehicles, and clothing (i.e., such as large parts of the surface of special safety clothing). When the headlights of a vehicle illuminate a retroreflective surface, the reflected light is directed towards the vehicle and its driver (rather than in all directions as with diffuse reflection), so as to better warn the driver of the vehicle that there is something up ahead.

Part of the surface of each partition section 12 of the apparatus 10, may have retroreflective tape or stripes. This way each partition section 12 may become much more visible in the dark for observers near a light source, such as the driver of a vehicle with its headlights on. The pattern of the retroreflecting stripes may also help to distinguish between objects and people. Area reflective tape or fabric is one of the most effective ways of drawing attention to an object, whereby drivers may be able to easily distinguish an objects shape at night.

One way to customize the look of the apparatus 10 is to utilize adhesive tape along the surface area of each partition section. Alternatively, each partition section 12 may be covered with a reflective paint or reflective adhesive tape. The reflective tape or material may be secured to each partition section 12 of the apparatus 10 by any appropriate means. In an exemplary embodiment, the reflective tape or material may be glued, taped, ironed on, or secured by any other appropriate means to secure the reflective tape or material to the surface area of each partition section 12 of the apparatus 10.

The reflective tape or material may be of any appropriate shape, size, type or configuration. The reflective tape or material may comprise 3M™ Scotchlite™ reflective products and the like. The width of the reflective tape or material may be determined by its reflection properties as it may relate to distance and safety study results. The 3M™ Scotchlite™ reflective tape or material may help enhance the visibility of the apparatus 10 in nighttime or low-light conditions when illuminated by a light source, such as headlights, by returning the light back toward the original source and reaching the automobile driver's eye. Fluorescent colors may also be utilized to enhance daytime and low-light visibility.

The surface area of each partition section 12 may also comprise a specific internal pattern that may be similarly fabricated from the reflective tape or any other appropriately reflective material. In an exemplary embodiment, the internal pattern may generally be of an "X" shape or pattern. It is to be understood, however, that the internal pattern may be of any desired shape or figure, such as a circle, square, SOS, and the like, and should not be limited to that described herein.

For greater visibility during the daytime, very bright colors may be used for the partition sections 12 of the apparatus 10, such as by means of fluorescent paint, tape or material. In an exemplary embodiment, a surface area of each partition section 12 may include colors such as orange, yellow, white, or as desired. Reflective and non-reflective widths, patterns, and colors of the apparatus 10 may vary. Specific internal patterns of designs may also be considered for colorblind individuals. As an alternative, the surface area of each partition section 12 may include a three dot, three dash, three dot (i.e., SOS) image, a large "SOS" image, an "ACCIDENT AHEAD" image, a "CONSTRUCTION AHEAD" image, or may include a sign that may be selectively programmed to show or display any desired image or signage on each partition section.

The expandable roadside safety apparatus 10 may include any number and types of removably attachable devices or components. In an exemplary embodiment, the apparatus 10 may include at least one stabilizing component 46, at least one lighting component 52, and the like. Depending upon the embodiment utilized, the expandable roadside safety apparatus 10 may include one or more cable protectors 48. The cable protector(s) 48 may be placed over the first cable located adjacent the first end 18 of the partition 12, whereby a vehicle may drive over the cable without causing any damage to it, as shown in FIG. 1. The cable protectors 48 may be any appropriate shape, size, type or configuration, such as any of the drop over or drive over cable protectors 48 commercially available on the market.

The weighted base portion 16 may include any appropriate number or type of stabilizing components 46, such as a plurality of stabilizing components. As shown in FIGS. 1, 3 and 9, the stabilizing components 46 may aid in further stabilizing and/or anchoring the apparatus 10 to the ground. The stabilizing components 46 may be of any appropriate shape, size, type or configuration. The stabilizing components 46 may comprise legs, cables or the like. In an exemplary embodiment, the stabilizing components 46 may be secured at one end to the weighted base portion 16, extend outward from the weighted base portion 16 and be further secured to the ground by any appropriate means, such as with stakes 50, as shown in FIGS. 1, 3, 6 and 9.

The stabilizing components 46 may be utilized to aid in securing the apparatus 10 to the ground. The stabilizing components 46 may be located at any appropriate position along the weighted base portion. In an exemplary embodiment, the stabilizing components 46 may be located at a spaced distance away from one another laterally along the length of the weighted base portion 16 of each partition section 12.

Figure 4:
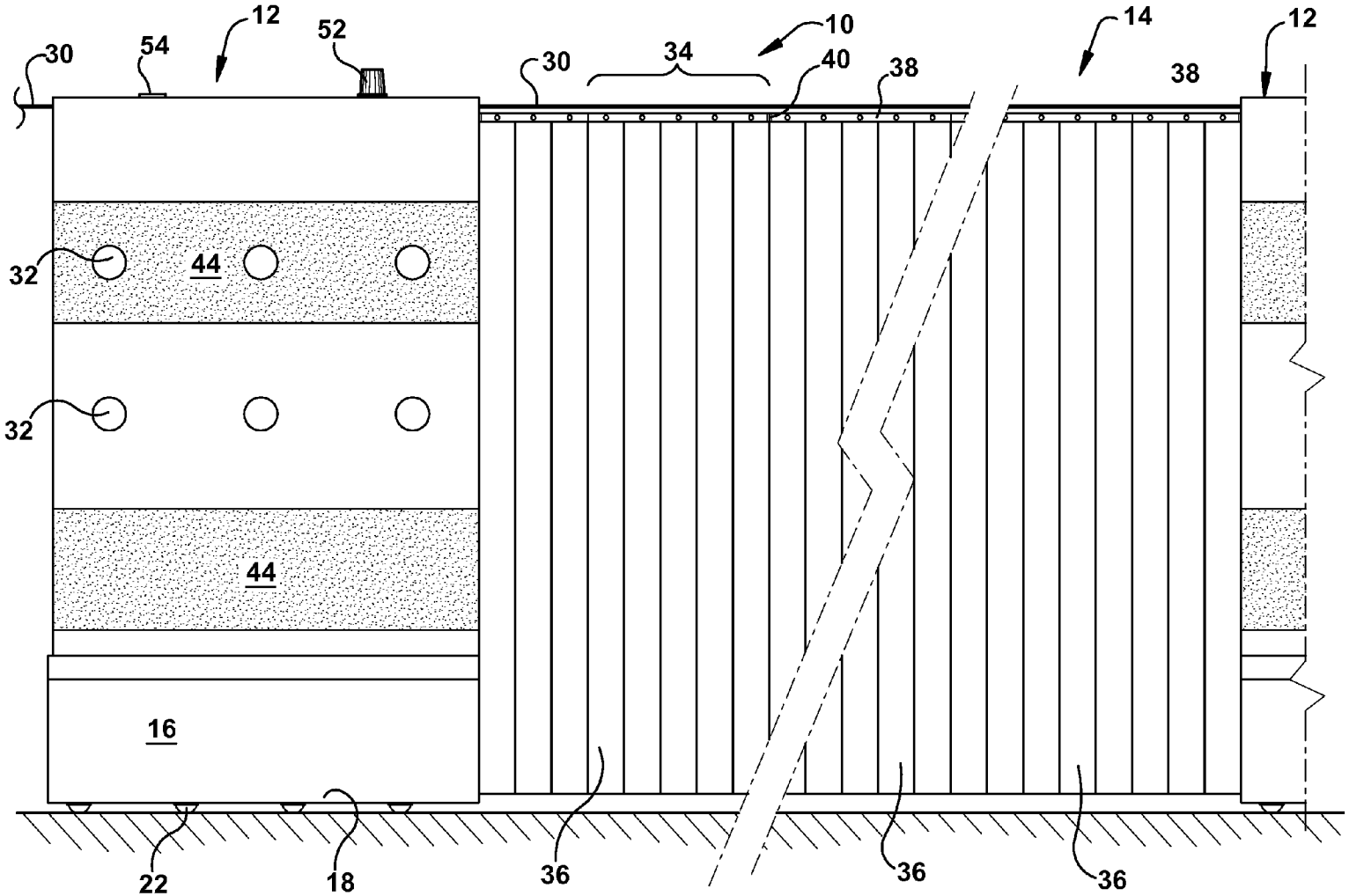
FIG. 4 illustrates a front view of an embodiment of the expandable roadside safety apparatus.

With reference to FIGS. 1, 4 and 9, the apparatus 10 may include a plurality of lighting components 52. Emergency flashing lights may play a vital role at hazard, accident and construction sites. The lighting components 52 may alert casual passersby and emergency personnel alike to the situation at hand. This in turn may promote safety and efficiency at the scene of the emergency and may help to mitigate any damage that may have been done.

The lighting components 52 may be secured to the apparatus by any appropriate means, such as by fasteners, adhesives or the like. Moreover, the lighting components 52 may be located at any appropriate position on the apparatus 10, such as at various points on the partition sections 12. The lighting components 52 may be of any appropriate shape, size, type or configuration. The lighting components 52 may utilize any appropriate type(s) of lighting technology or bulbs.

In an exemplary embodiment, the lighting components 52 may utilize light emitting diode (LED) technology. The lighting components 52 may be high intensity directional light emitting diodes. LED bulbs typically last far longer than traditional strobe or halogen bulbs, and in many cases, they never need replacing. Moreover, LED bulbs shine at a 360-degree radius and may be visible from great distances.

The lighting components 52 may also operate a variety of flashing light patterns and may be of any appropriate color. The lighting components 52 may operate a flashing SOS pattern in Morse code during an emergency situation. The lighting components 52 may comprise a tab pull strip, whereby when the strip is pulled the lighting component 52 may be activated via a battery. This may help save the battery from deterioration before use and only operating the battery of the lighting component 52 when needed, such as in the dark and/or in poor weather and sight conditions.

In an alternative embodiment, the expandable roadside safety apparatus 10 may also include a Global Positioning System (GPS) component 54, as shown in FIGS. 1, 4 and 9, to communicate with local police and fire departments and/or to communicate info regarding possible traffic slowdowns due to accidents or construction. The GPS component 54 may be any appropriate type of component, such as a GPS receiver or the like. The GPS component 54 may provide data and various related identifying location information. The GPS component 54 may operate in conjunction with any appropriate data sending and receiving components and systems. For example, the GPS component 54 may communicate with satellites, Wi-Fi networks, or may determine location data from any other data sources from the local environment that may communicate the appropriate data.

The GPS component 54 may be activated by any appropriate means. For example, the GPS component 54 may be activated by pushing a button or by removing the pull tab strip for the lighting component 52 for battery activation of the lighting component. This action may also activate the GPS component. The GPS component 54 may be a separate component or may be included with one of the lighting components. For example, the GPS component 54 may be integral with one or more of the lighting components. Alternatively, the GPS component 54 may be a separate component that may also be removably secured or attached to the apparatus 10 via fasteners, adhesive, and the like.

Although the embodiments of the present invention have been illustrated in the accompanying drawings and described in the foregoing detailed description, it is to be understood that the present invention is not to be limited to the embodiments disclosed, but that the invention described herein is capable of numerous rearrangements, modifications and substitutions without departing from the scope of the claims hereafter.

The invention claimed is:

1. An expandable roadside safety apparatus comprising:

at least two partition sections, wherein each partition section comprises:

a base portion;

at least one cable located laterally through the base portion; and a plurality of rollers;

wherein the partition sections are configured to be extended and retracted via the at least one cable;

at least one curtain section, wherein each curtain section comprises:

at least one foldable section;

at least one mounting bar; and a plurality of strips;

a plurality of hinges secured between the partition sections and curtain sections, wherein the partition sections are configured to be hingedly secured to each other and to the curtain sections; and wherein the partition sections and the curtain sections may be interspersed between one another, wherein the apparatus is configured to be extended and retracted along the at least one cable.

2. The apparatus according to claim 1, wherein said apparatus is capable of being retracted into a storage position via the at least one cable.

3. The apparatus according to claim 2, wherein one end of the at least one cable is configured to be secured to a winch.

4. The apparatus according to claim 2, wherein the curtain sections are configured to provide ingress and egress to either side of the apparatus.

5. The apparatus according to claim 1, wherein the base portion includes at least one stabilizing component.

6. The apparatus according to claim 5, wherein the at least one stabilizing component is a cable configured to be secured to the ground.

7. The apparatus according to claim 1, further comprising at least one lighting component secured to the partition sections.

8. The apparatus according to claim 1, further comprising a GPS component secured to the partition sections.

9. The apparatus according to claim 1, wherein each partition section includes a plurality of wind vents located laterally along the partition section.

10. The apparatus according to claim 1, wherein each partition section includes a plurality of reflective portions.

11. The apparatus according to claim 10, wherein the reflective portions comprise a reflective tape.

12. The apparatus according to claim 11, wherein the reflective portions are displayed in a specific pattern on the partitions.

13. An expandable roadside safety apparatus comprising:

a plurality of partition sections, wherein each partition section comprises:

a base portion;

a first cable located laterally through the base portion;

a second cable located laterally through an end opposite that of the base portion; and a plurality of rollers secured to the base portion;

wherein the partition sections are configured to be extended and retracted via the first cable and the second cable;

a plurality of curtain sections, wherein each curtain section comprises:

at least one foldable section;

at least one mounting bar; and a plurality of strips;

a plurality of hinges secured between the partition sections and curtain sections, wherein the partition sections are configured to be hingedly secured to each other and to the curtain sections; and wherein the partition sections and the curtain sections may be interspersed between one another, wherein the apparatus is configured to be extended and retracted along the first cable and the second cable.

14. The apparatus according to claim 13, wherein the curtain sections are configured to provide ingress and egress to either side of the apparatus.

15. The apparatus according to claim 13, wherein the base portion includes at least one stabilizing component that is configured to be secured to the ground.

16. The apparatus according to claim 13, further comprising at least one lighting component secured to the partition sections.

17. The apparatus according to claim 16, wherein the at least one lighting component comprises a high intensity directional light emitting diode.

18. The apparatus according to claim 13, further comprising a GPS component secured to the partition sections.

19. The apparatus according to claim 13, wherein each partition section includes a plurality of wind vents located laterally along the partition section.

20. The apparatus according to claim 13, wherein each partition section includes a plurality of reflective portions.

* * * * *